United States Patent [19]

Neumeier et al.

[11] 4,326,937

[45] Apr. 27, 1982

[54] GRAB MECHANISM

[75] Inventors: Karl E. Neumeier, Stillwater; Robert J. Sullivan, Crystal, both of Minn.

[73] Assignee: PaR Systems Corp., St. Paul, Minn.

[21] Appl. No.: 187,750

[22] Filed: Sep. 16, 1980

[51] Int. Cl.[3] ..... C25C 7/00; C25C 7/06

[52] U.S. Cl. ..... 204/198; 204/225

[58] Field of Search ..... 204/194, 198, 225, 226

[56] References Cited

U.S. PATENT DOCUMENTS 2,421,209 5/1947 Lindner ..... 204/225

4,028,211 6/1977 Hirakawa ..... 204/225

FOREIGN PATENT DOCUMENTS 324296 2/1972 U.S.S.R. ..... 204/225

*Primary Examiner*—T. M. Tufariello

*Attorney, Agent, or Firm*—Kinney, Lange, Braddock, Westman and Fairbairn

[57] ABSTRACT

A grab mechanism device for transporting a plurality of vertically oriented plates having lift lugs from a holding container such as a vat. The grab mechanism is mounted on a vertically movable load frame. The grab mechanism and load frame overlie the vat. An aligner frame is slidably mounted relative to the load frame and has guides for aligning said aligner frame with the holding container and also overlying the plates. The load frame can be lowered relative to the aligner frame forming part of the grab mechanism in position to engage the lift lugs of the plates. The grab means is selectively controlled to engage a set of the plates in the container or vat.

The plates are lifted out of the container by lifting the load frame and grab mechanism relative to the aligner frame.

The aligner frame includes "combs" for interdigitally separating the bottom of the plates from one another after the plates have been lifted from the holding container. Then the load frame grab mechanism plates and aligner frame may be lifted clear of the container and moved by a crane, for example, to a remote location.

The grabs means comprises a plurality of pivoted lug engaging means adapted to intersect the lift lugs on the plates to support the weight of the plates. The plurality of lug engaging means may preferably comprise alternating pairs controlled to selectively intersect lugs on alternating plates.

15 Claims, 9 Drawing Figures

29
28
42C
42B
34
46
37
36
20
44
16
15
47
45
42
30
51
18
32
14
50
17
19
52
43
24
53
53A
44C
40
41
27

GRAB MECHANISM

BACKGROUND OF THE INVENTION

In the metal manufacturing processes where electrolytic plating is used, vast numbers of anodes and cathodes are employed to collect or discharge metal. Other processes for treating liquid employ vertically oriented plates as electrodes, separators and the like.

In all of these industries, the transporting of the plates to vats and from storage and the like is required. Grabbing single plates with a hoist from transportation to or from remote locations is highly inefficient. Relatively complicated devices for grabbing a plurality of plates have until now required substantial labor to safely and selectively attach to the plates which are desired. Oftentimes, anodes and cathodes are adjacent one another, and only one or the other is to be transported. Electrolytic plating and other processes use dangerous chemicals which may be harmful to a worker required to come in close contact with the plates during movement of the plates. It is of substantial value to the metal processing industry and to other industries to have a device which permits the selective transportation of a plurality of vertically oriented plates with a minimum degree of difficulty.

SUMMARY OF THE INVENTION

The present invention relates to a grab mechanism device for transporting a plurality of vertically oriented plates having lift lugs to permit lifting or lowering a plurality of the plates as a set from or into a holding container such as a vat. If the plates comprise two sets of interdigitated plates (for example alternate anode and cathode plates), different lift lugs are provided on the different sets and two grab devices, one for each type of plate, are provided.

The device comprises a mast for association with a controlled hoist. A load frame is provided which is attached to the mast and has a horizontal portion. Also included is an aligner frame having a horizontal portion and a vertical portion, with the horizontal portion having guide means for aligning the aligner frame with the holding container for the plates. The vertical portion is slidably guided on the load frame. A grab frame is carried by the horizontal portion of the load frame and has a plurality of grab means sized to engage the lift lugs of at least one set of plates. The grab means are controlled to selectively engage the associated lift lugs.

The device preferably further includes means for shifting the grab frame along a horizontal portion of the load frame to selectively position the respective grab means in operating relationship with its associated set of lift lugs on the different sets of plates. The grab frame may be mounted on the horizontal portion of the load frame with rollers to permit the movement of the grab frame with respect to the load frame.

The grab means include a plurality of pivoted lift lug engaging means adapted to intersect the lift lugs to support the weight of the plates. In a preferred embodiment, the plurality of lift lug engaging means comprise alternating pairs of lift lug engaging means selectively controlled to intersect lugs on alternating plates.

The lug engaging means should preferably include centering means for positioning the lug engaging means with respect to the lift lugs. Stops may be provided to limit the movement of the lug engaging means to prevent displacement of the plates. Of course, movement of the grab frame with respect to the load frame may also be restricted by limit switches located to position the grab frame at a desired position.

The aligner frame which aligns the entire device with respect to the holding container contains guide means as shown including a locating pin that cooperates with a pin receiving receptacle located on the holding container. In a preferred embodiment, the vertical portion of the aligner frame includes a track and the load frame includes rollers for cooperatively moving on the track to permit said load frame to be lowered and raised relative to the aligner frame by lowering the mast. If desired, the tracks on the vertical portion of the aligner frame may be tapered to permit more movement of the rollers as the load frame is lowered. Of course, if desired, the aligner frame may include a stop limiting the distance the load frame can be lowered and it does have a stop limit to prevent raising the load frame too far.

In one embodiment of the present invention, the aligner frame includes a comb-like device for interdigitally separating the bottom of the plates which are picked up from one another, after the plates have been lifted from the holding container. Moreover, as a safety precaution, the device further may include safety support bars attached to the load frame and positioned adjacent the support lugs so as to be swung into position and prohibit downward movement of the support lugs when the plates are supported by the lift lugs.

BRIEF DESCRIPTION OF THE DRAWINGS

FIG. 1 is a side elevational view of the preferred embodiment of the present invention;

DESCRIPTION OF PREFERRED EMBODIMENT

Figure 2:
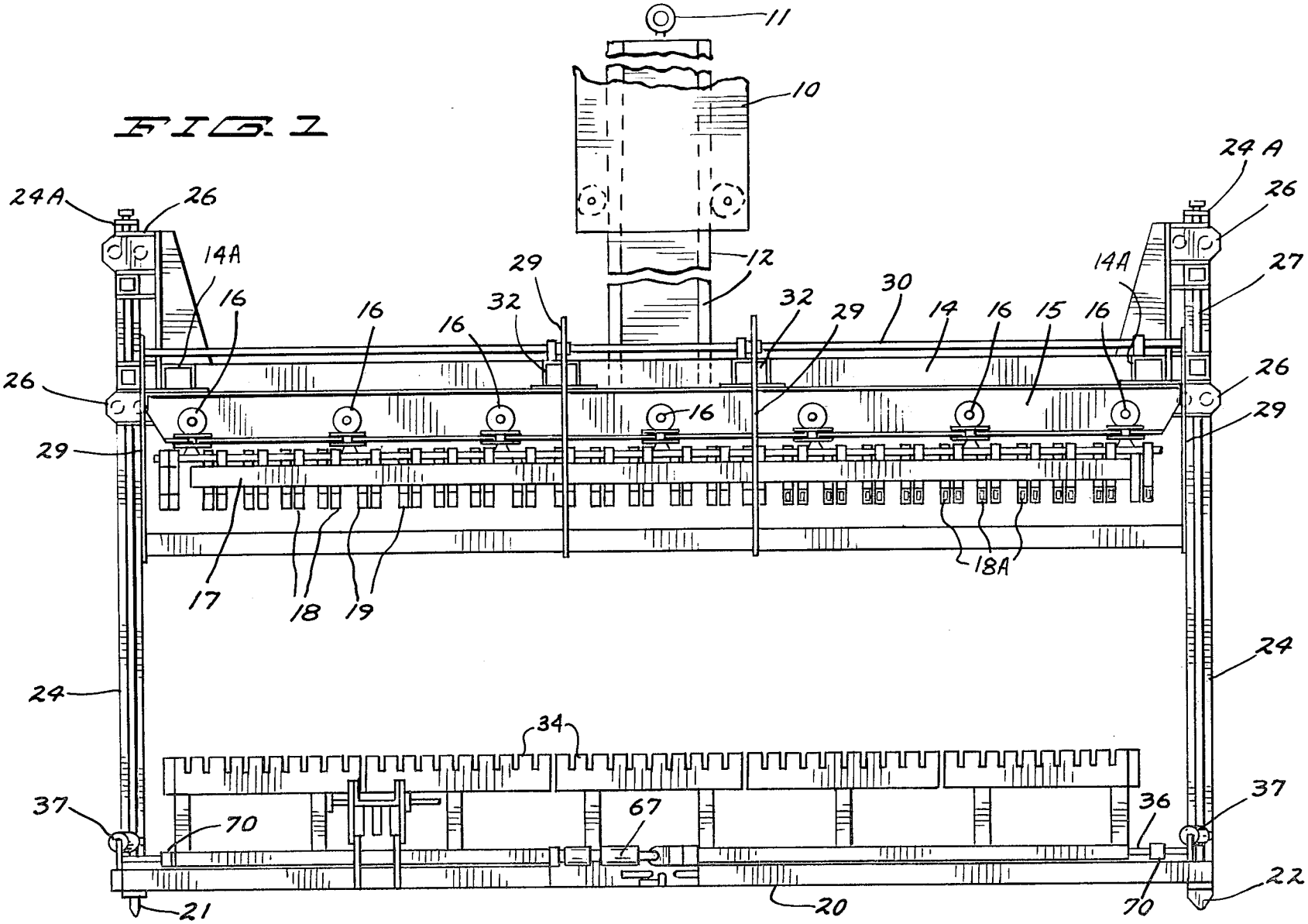
FIG. 2 is an end view of the device shown in FIG. 1, with one of the parts shown in two possible positions.
Figure 2:
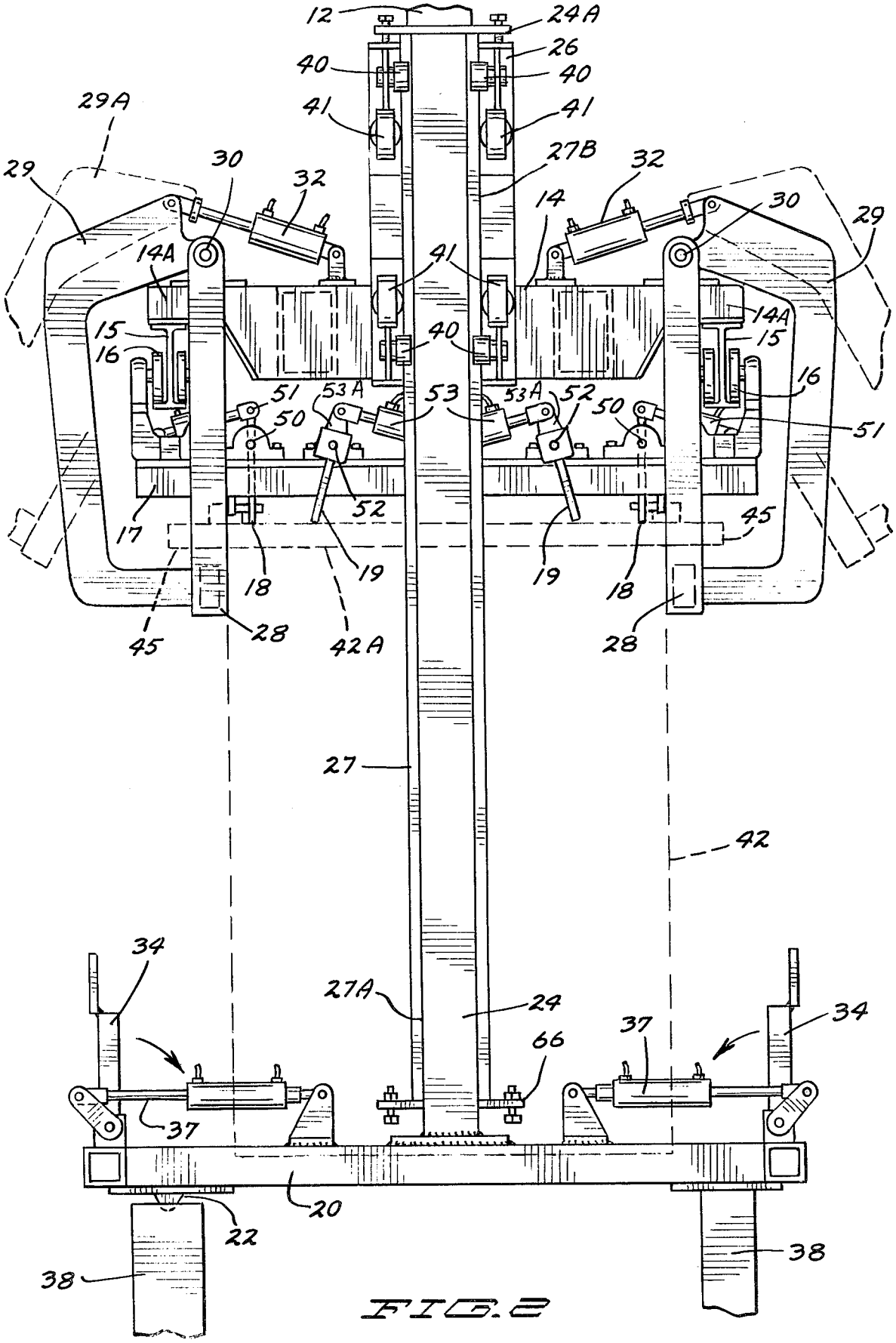

As shown in FIG. 1, an outer guide slidably guides a mast 12 which supports the entire device. An eye 11 may be attached to a cable coming from a winch or other conventional hoist to raise and lower the mast and the entire device vertically.

Load frame 14 is mounted directly on mast 12. The load frame has transverse cross members 14A at its ends. Positioned on the horizontal portion of load frame 14 is a horizontal track 15 (see FIG. 2 as well) on which a plurality of rollers 16 are guided. Rollers 16 are mounted on grab frame 17, which also supports two separate sets of grab means 18 and 19.

Positioned below the load frame 14 is aligner frame 20 which contains aligner pins 21 and 22 for engagement with a holding container or vat 38 shown in FIG. 2. End vertical members 24 of aligner frame 20 are slidably guided on load frame brackets 26 via rollers and track portions 27.

A pair of support bars 28, which are used for secondary of safety support are each carried by C-shaped arms 29 mounted on pivot shafts 30 on opposite sides of frame 14 for activation by a pivot means 32 comprising a double acting cylinder.

A comb device 34 (FIGS. 1 and 8) for interdigitally separating plates carried by the grab means is mounted on shaft 36 which is attached to aligner frame 20. Piston and cylinder means 37 regulates the pivoted position of the comb means 34.

Figure 4:
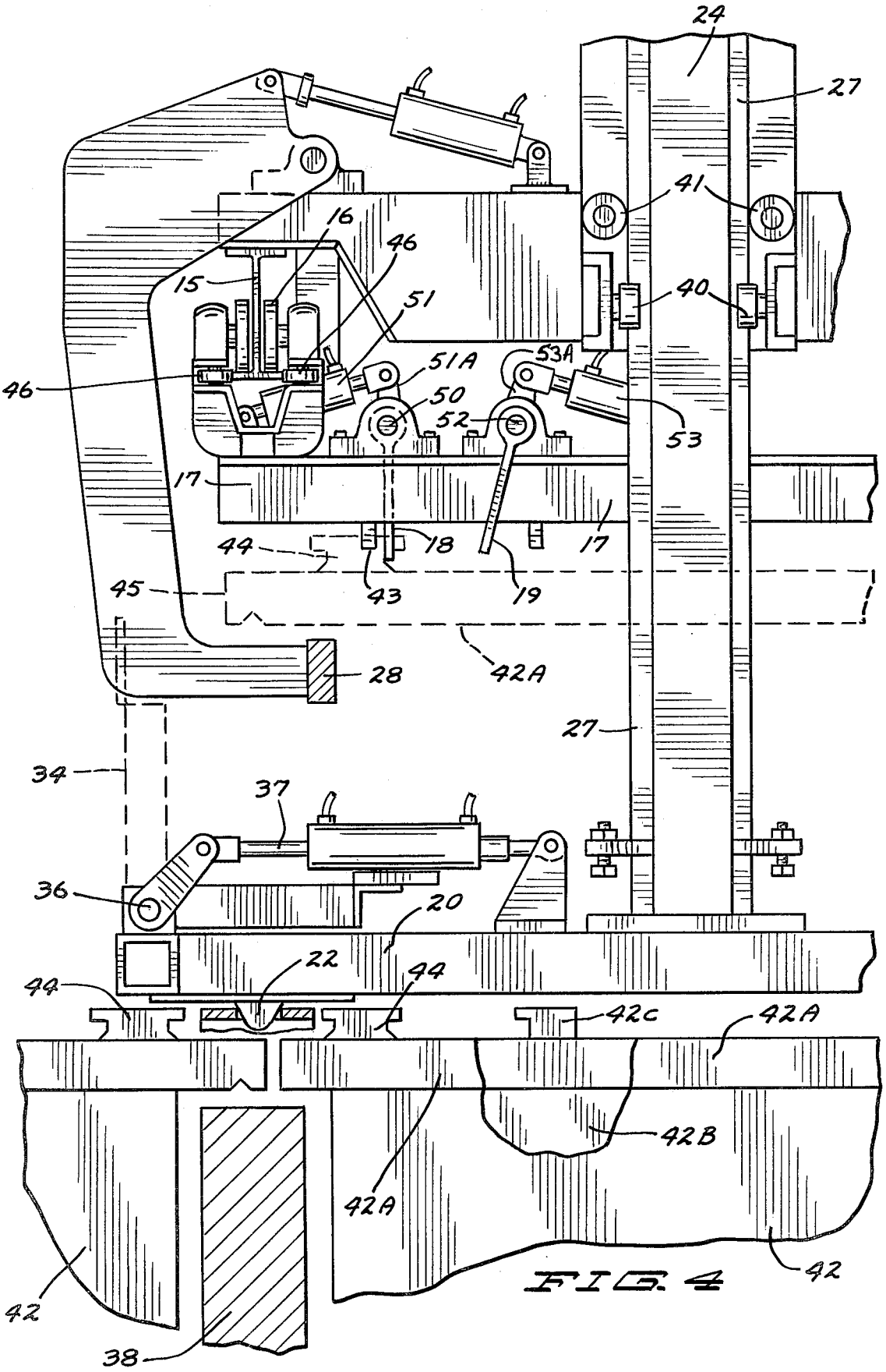
FIG. 4 is an enlarged view of a different portion of the view shown in FIG. 2, with another part shown in two possible positions.

Initially the device carried as shown in FIG. 1, except that the comb members are horizontal, as shown in FIG. 4. The vertical members 24 are all the way down and stops 24A carried at the top of vertical members 24 are resting on portions of brackets 26, which are fixed to the ends of frame 14 and thus to mast 12.

Lowering of the entire device through mast 12 in position over a holding container allows aligner pins 21 and 22 to interact with the upper edge of a holding container or vat 38 as shown in FIG. 2 to position the aligner frame 20.

Figure 3:
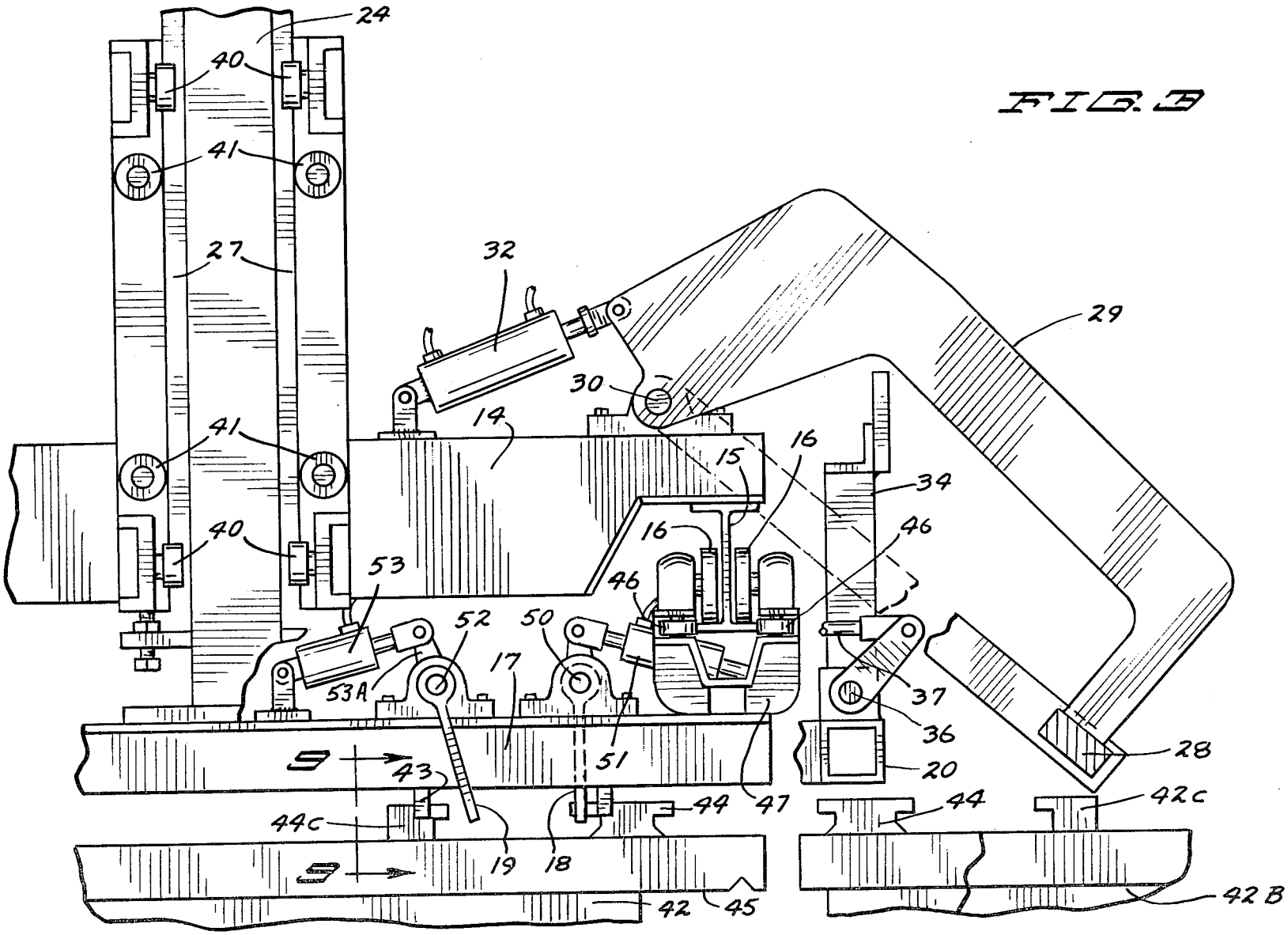
FIG. 3 is an enlarged view of a portion of the device shown in FIG. 2.
Figure 9:
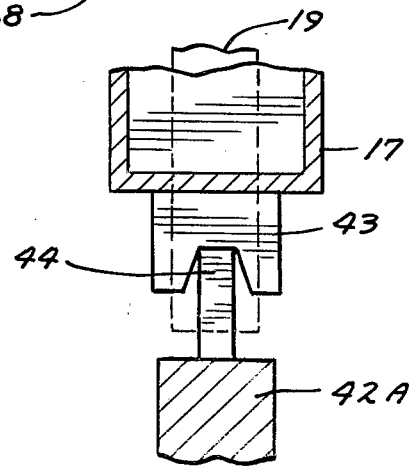
FIG. 9 is a view along lines 9—9 of FIG. 3.

The vertical members 24 provide a sliding guide for load frame brackets 26 via rollers 40 and 41 which are mounted on brackets 26 and which engage track portion 27. The mast 12 is lowered after the aligner frame 20 has engaged the top of vat 38 and secondary supports 28 have been pivoted outwardly to position shown in FIG. 3. After the mast is lowered about two feet the combs 34 are pivoted to their position shown in FIG. 1. The load frame 14 and load frame brackets 26 slide down along track 27 as guided by rollers 40 and 41 into position near plate 42 as shown in FIG. 3. Plate 42 represents one of the plates of a set such as an anode or cathode plate which is to be moved. As shown in FIG. 9, the plate 42 has a top cross member or header 42A which carries lift lug 44 and guide 43 gently centers the plate 42 and lift lug 44 to permit proper engagement with grab means 18 as hereinafter described.

In a vat for metal processing, anode and cathode plates alternate (one anode and one cathode). One set of plates, for example, the anodes 42, have lugs 44. The other set of plates, for example, the cathodes 42B have lugs 42C at the top edges as shown in FIGS. 4 and 5.

The grab frame 17 is supported on track 15 by rollers 16 for limited horizontal movement on the track. Additionally, rollers 46 are carried by support 47 as shown in FIGS. 4 and 5 for engagement of the lower side edges of track 15. In the device shown herein, the grab frame 17 has a pair of shafts 50 which support a plurality of grab means 18. The shafts 50 are pivoted via double acting cylinders 51 acting through an arm 51A attached to each shaft 50. Cylinders 51 have their base ends attached to frame 17. The shafts 50 are perpendicular to the plane of the plates. Likewise, shafts 52, parallel to shafts 50, carry a plurality of grab means 19. Shafts 52 are pivoted by cylinder 53, the base end of which is mounted on support 54. An arm 53A, is fixed to shafts 52 and is moved by operating cylinder 53. Selective operation of cylinders 52 or 53 will cause a movement of the grab means 18 or 19 about the axes of shafts 50 or 52. As the grab means 18 are pivoted, they engage lift lugs 44 as shown in FIG. 3. Each grab means 18 may be a flat bar with an opening 18A (typically shown in FIG. 1) which fits around the outwardly extending portions of lug 44.

Figure 5:
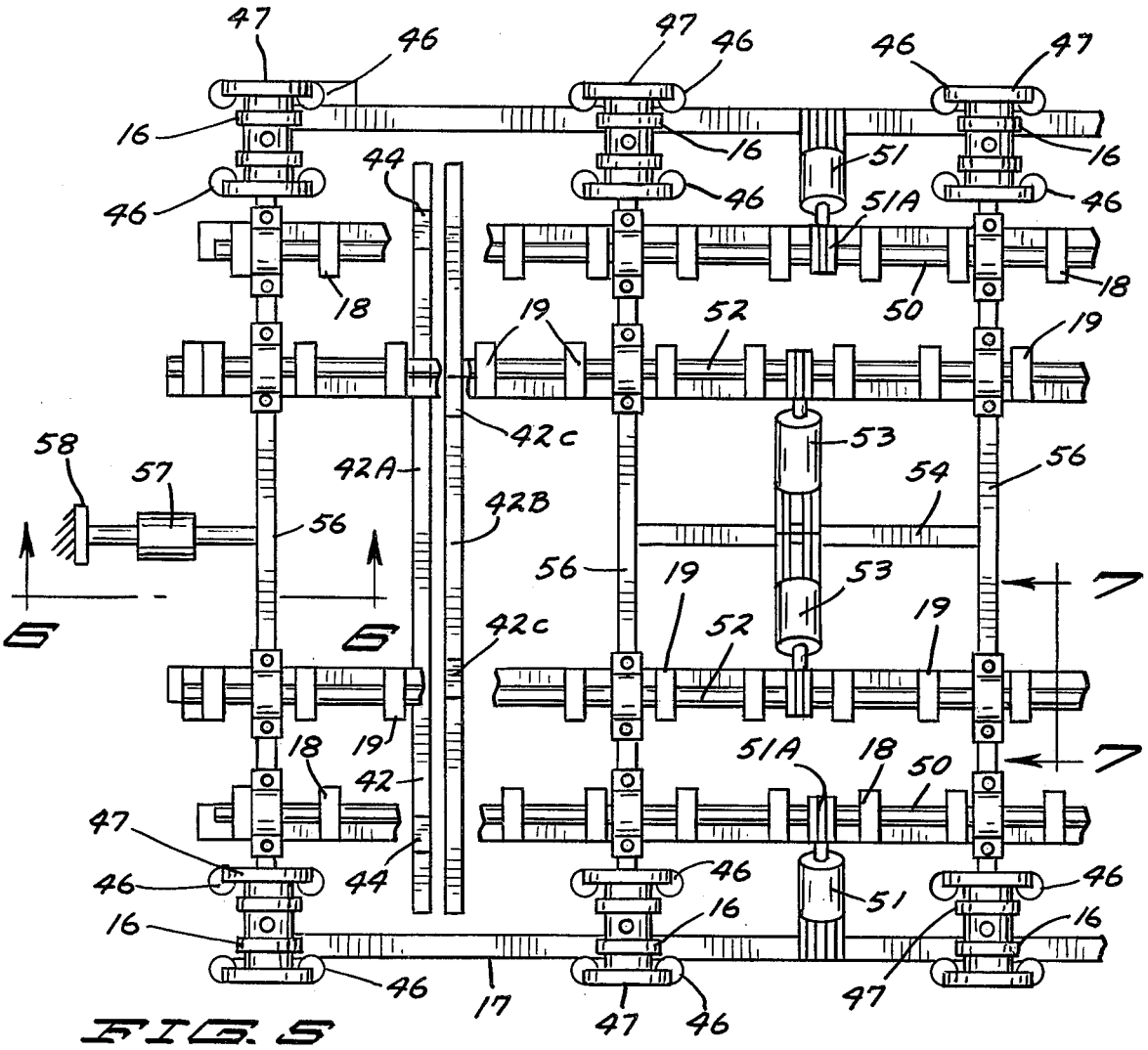
FIG. 5 is a top view of part of the device shown in FIG. 1.
Figure 6:
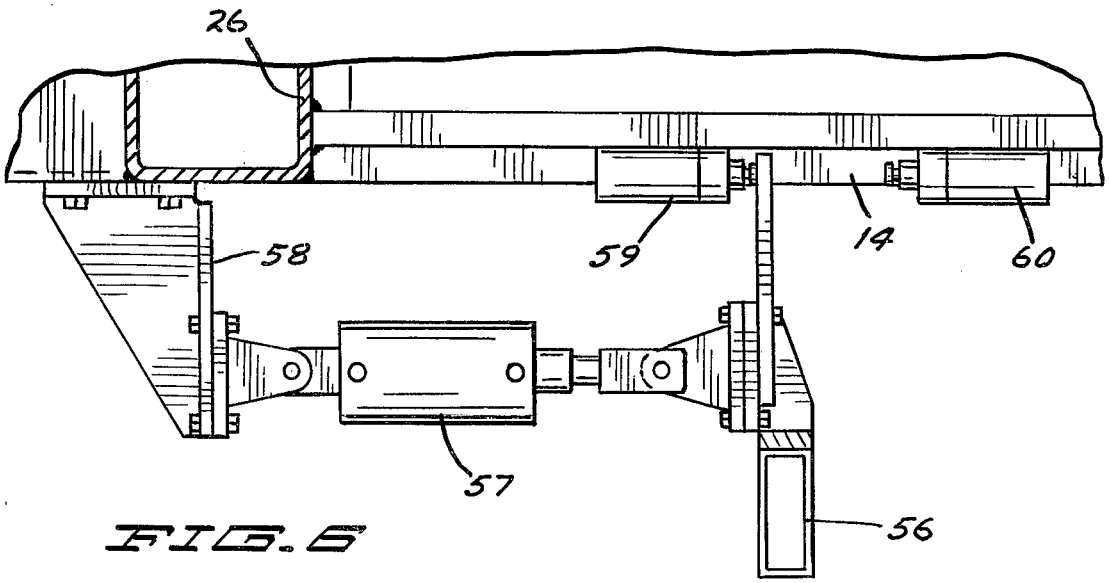
FIG. 6 is a view along lines 6—6 of FIG. 5.

Attached to grab frame 17 are a number of cross members 56 which are shown in FIG. 5. A cylinder 57 is attached to bracket 58 and may be activated to slide cross member 56 (and thus the frame 17) from limit switch 59 to limit switch 60 along track 15. The rollers 46 and 16, which are supported by track 15 permit such movement to adjust the relative position of the grab means 18 and 19 with respect to the lugs 44 or 42C, depending on whether plates 42 or 42B held in the vat 38 are to be lifted.

If the spacing between limit switches 59 and 60 is adjusted properly, the cross member 56 of grab frame 17 can be moved to permit engagement of every other plate 42 or 42B by grab means 18 or 19, respectively. However, if either grab means 18 or grab means 19 are spaced properly along shafts 50 and 52, limit switches 59 and 60 can position the grab means 18 or 19 so as to interact with every other plate, or every fourth plate, or even all of the plates, depending upon the spacings of the plates and the types of lift lugs provided thereon.

Figure 7:
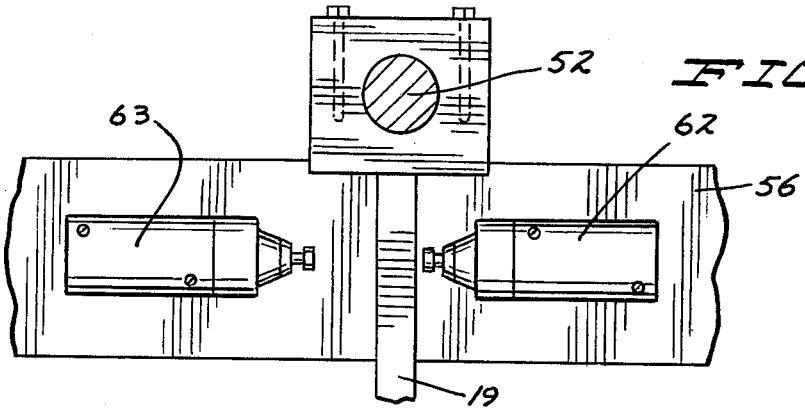
FIG. 7 is a view along lines 7—7 of FIG. 5.

Rotation of shaft 50 via cylinder 51, or shaft 52 via cylinder 53 will then cause the grab means 18 or 19 to engage the set of plates. The plurality of grab means permit picking up all of the anode or cathode plates in a vat at once. As shown in FIG. 7, limit switches 62 and 63 can be placed on both sides of grab means 19 so as to prevent excessive rotation of shaft 52, thereby preventing displacement of the plates after engagement of the plate by the grab means 19. Limit switches 62 and 63, as well as any of the other limit switches shown herein, can be operably connected to control means for automation of the device. The rotating limits of grab means 18 may also be controlled with limit switches as shown.

Figure 8:
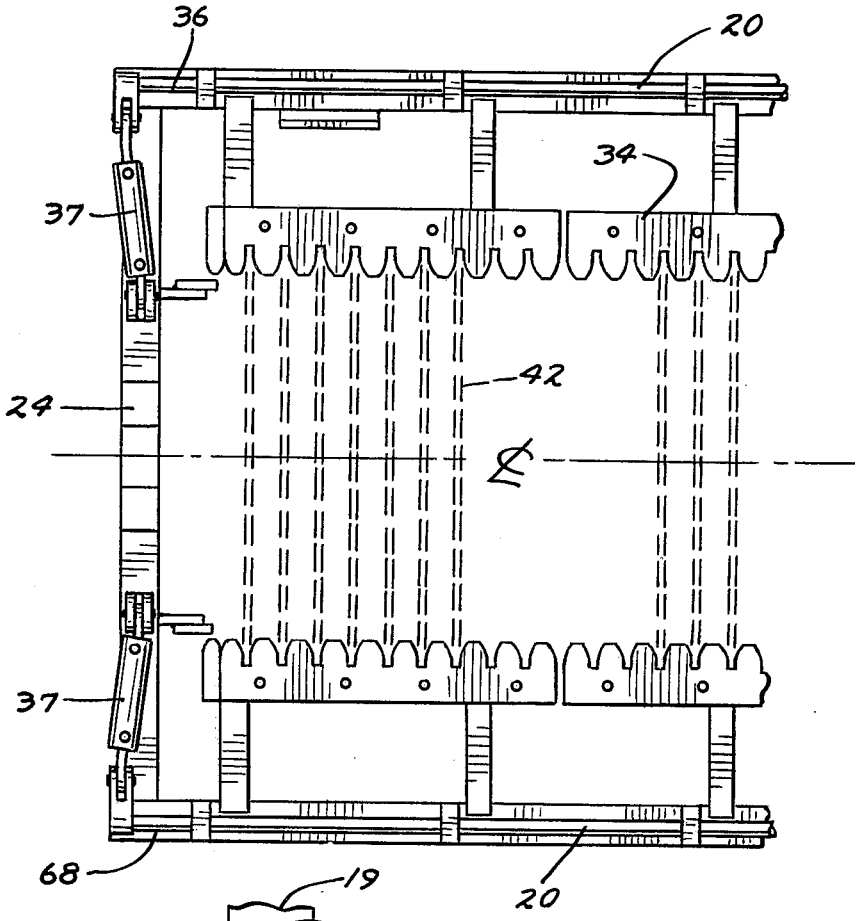
FIG. 8 is a top view of part of the device shown in FIG. 1.

After the lugs 44 or 42C have been engaged by the grab means 18 or 19, the mast and therefore load frame 14 and grab means 17 may be lifted upwardly moving the support lugs 45 away from the vat 38. This will lift a set of plates 42 or 42B as well. When the grab means and plates 42 (42B) have been lifted so the tops of the plates are above the ends of combs 34, which are in their vertical position, cylinders 37 again actuate combs 34 to a horizontal position as shown in FIG. 8. The combs 34 are carried on shafts 36 which are mounted on opposite sides of frame 20.

The combs 34 keep the plates 42 (or 42B) separated and prevent damage during transport to and from the vat. The combs also provide guides for the plates when a set of plates is lowered into a vat during the insertion sequence.

After the combs have been lowered, the support bars 28 can then be lowered under the support lug 45 by rotation of C-shaped arms 29 about shafts 30 via cylinders 32. Thus, if a top lug 44 or 42C were to slip or break, the secondary support bars 28 would catch the support lug 45 at the ends of the top members 42A (or the top member on plates 42B) thereby preventing damage to the plates and possible injury to those associated with the device.

After the secondary support bars 28 have been positioned (there is one on each side of the plates), the mast 12 can be further lifted so that the bottom of the plates 42 (or 42B) are approximately adjacent the aligner frame 20. Track 27, contained on vertical member 24 of aligner frame 20, may be tapered from a narrow end 27A to a wider end 27B (FIG. 2) so that the movement of rollers 40 and 41 is most free when the aligner frame 20 is closest to the grab frame 17 and load frame 14. As the rollers progress up the track 27 to a position adjacent wider portion 27B, the rollers can engage the track 27 firmly for more stability and when stop members 24A are engaged, the aligner frame 20 will be lifted. The lower limit of the descent of load frame 14 can be controlled by stop member or plate 66 (FIG. 2), which can also be a limit switch if full automation is desired. Similarly, the stop 24A limits the maximum distance that load frame 14 can be lifted without additionally lifting aligner frame 20. Again, a limit switch may be placed at plate 24A for information to be used in automated control.

In operation, the device of the present invention is brought into position over a vat containing a plurality of plates via an overhead crane carrying tube 10. Secondary support bar 28 is pivoted away from the frame 14 as shown in FIG. 3. The hoist 10 lowers mast 12 into position so that the aligner pins 21 and 22 engage vat 38. The device is now broadly aligned for use with the plates 42 or 42A contained in the vat 38.

The hoist continues to lower mast 12 so that the load frame 14 and grab frame 17 move down the vertical support member 24 of aligner frame 20 as guided by rollers 40 and 41. The combs 34 are moved to their vertical position at an appropriate time after the grab frame has lowered about two feet. The bottom plate or limit switch 66, or the action of the operator, halts the lowering operation.

Then, depending upon which set of plates are desired to be removed, the grab frame 17 is positioned by cylinder 57 at the limits set by limit switches 59 or 60 so that grab means 18 or 19 are in position. Also combs 34 are properly positioned. Plates 42 (if these are the plates to be lifted) engage guide member 43 to position the top rails of the plates and lugs 44 (or 42C) which are on the tops of plates 42 (or 42B). Rotation of grab member 18, for example, about shaft 50 by cylinder 51, as shown in FIG. 3, causes engagement of hook or grab means 18 about lift lugs 44 on plates 42. Limit switches prevent movement of any of the grab means 18 to a position which would interfere with the orientation of the plates.

The mast 12 is then raised to lift grab frame 17 away from the aligned frame 20 and thereby lift the plates 42 from the vat 38. After the plates have been lifted sufficiently so the support legs are above combs 34 (which are vertical) the combs are lowered by operating cylinder 37. Then at a desired position, the secondary support bars 28 may be moved into position as shown in FIG. 2 by rotating C-shaped arms 29 about shafts 30 with cylinder 32. The support bars 28 are located under the support lugs 45, which are formed by the extensions of the headers 42A beyond the sides of plate 42 (or 42B), thereby preventing possible damage of lugs 44. The load frame bracket 26 intercepts stop or limit switch 67. As has been described above, in a preferred embodiment, track portion 27B of track 27 is substantially wider than in 27A so that rollers 40 and 41 restrict upon the shaft or track 27B for later lifting of aligner frame 20. At this point the bottoms of plates 42 have been removed from the vat 38.

Cylinder 67 may be used to position the combs 34 with respect to the particular plates which have been withdrawn from the vat 38. Note the stop collar 70 on shaft 36 in FIG. 1. The plates can be transported to and from vats for use as desired in a particular process. The tube 10 may be supported on an overhead crane or track so the entire device including the lifted plates, can be moved to a remote location for cleaning or treatment. New plates can be moved into the vat from which the original plates were removed. In many operations several vats are arranged side by side and end to end. The overhead crane can be moved to permit servicing any of the vats in the array.

It should be noted that there are combs 34 on each side of the aligner frame so the lower portions of the plates which are lifted are held along both edges. The combs 34 on each side of the frame move as a unit when they are pivoted.

What is claimed is:

1. A grab mechanism device for transporting a plurality of generally vertically oriented plates having lift lugs and which plates are supported in a holding container having a fixed positioning member mounted thereon comprising:

a load frame having a horizontal portion;

an aligner frame having a horizontal portion and a vertical portion, said horizontal portion having guide means for engaging the fixed positioning member and thereby mechanically aligning said aligner frame with said holding container, and said vertical portion being slidably mounted relative to said load frame;

a grab frame carried by said horizontal portion of said load frame and having grab means sized to engage the lift lugs of at least one of said plates, said grab means being controlled to selectively engage said lift lugs; and means to permit lifting said load frame relative to said container.

2. The device of claim 1 wherein there are two separate sets of plates in the container, and which sets are interdigitated, and including means for selectively moving said grab frame along said horizontal portion of said load frame to selectively position and grab means in operating relationship with the lift lugs on either set of said plates.

3. The device of claim 2 wherein said grab frame includes a plurality of roller means and said horizontal portion of said fixed positioning member on said load frame includes track means for engaging said rollers to permit movement of said grab frame with respect to said load frame.

4. The device of claim 2 wherein said grab means includes two separate sets of pivoted lug engaging members, each set comprising a plurality of simultaneously actuated pivoted lug engaging members adapted to intersect the lift lugs of the plates of each set of plates and to support the weight of said plates.

5. The device of claim 1 wherein said aligner frame guide means includes locating pin means for cooperating with pin receiving means located on said holding container.

6. The device of claim 1 wherein the vertical portion of said aligner frame includes track means and said load frame includes roller means for cooperatively moving on said track means to permit said load frame to be lowered by lowering said mast means.

7. The device of claim 6 wherein said track means is tapered to permit more relative movement of said roller means laterally of the track means as said load frame is lowered.

8. The device of claim 6 wherein said aligner frame includes stop means limiting the distance said load frame can be lowered.

9. The device of claim 1 wherein said aligner frame includes a slotted comb member adjacent each side of the aligner frame, each of said comb members having a plurality of slots spaced to receive the bottom portions of plates supported by the grab frame after the grab frame has been lifted relative to the aligner frame and the comb members are in a first position.

10. The device of claim 1 wherein said plates have header means extending beyond the ends of the ends of the plates to form support bars, and outrigger support means pivotally mounted on opposite sides of said load frame and each having horizontal bars to stop any accidental movement of said support bars when said plates are supported by said lift lugs and the outrigger support means are pivoted to positions with the horizontal bars below said support bars.

11. A grab mechanism for lifting and transporting a plurality of vertically oriented plates having lift lugs and which plates are supported in a holding container, said plates being positioned in two sets with the plates of each set of plates being alternated with and generally parallel to the plates of the other set, comprising:

a load frame having a horizontal portion;

an aligner frame having a horizontal portion and a vertical portion, said horizontal portion having mechanical guide means for aligning said aligner frame in a known relation with said holding container and said load frame being slidably mounted for movement along said vertical portion;

a grab frame carried by said horizontal portion of said load frame and being movable horizontally therealong between first and second positions and having first and second grab means each selectively engageable with the lift lugs of selected plates of an associated set of said plates in a first position of the grab frame and each selectively engageable with the lift lugs of different selected ones of the other associated set of said plates in a second position of the grab frame, said first and second grab means being individually controlled to selectively engage said lift lugs; and means for lifting said load frame along said vertical portion of said aligner frame.

12. A grab mechanism for selectively transporting one set of first and second sets of plates each set comprising a plurality of generally upright plates having first and second sets of lift lugs adjacent the tops thereof, respectively, and which plates are normally supported in a holding container, the plates of the first set being interdigitated with the plates of the second set, the first set of lift lugs being positioned at a different location laterally along the first plates than the lateral position of the second set of lugs along the second plates, and each plate having two spaced lugs thereon, the grab mechanism comprising:

a load frame selectively movable vertically toward and away from a first position adjacent the holding container, said load frame having a longitudinal length in direction perpendicular to the plates and a lateral width generally parallel to the plates;

means for aligning said load frame with said holding container in a preselected mechanically located position;

grab means mounted relative to the load frame for movement therewith, said grab means comprising first and second pairs of lug support assemblies, each pair of assemblies comprising a plurality of laterally spaced apart lug support members mounted on the load frame, said lug support members of each assembly being spaced along the longitudinal length of the load frame, and each pair of lug support assemblies being selectively movable to move the lug support members from lug supporting to lug clearing positions, respectively, said grab means being movable in longitudinal directions along said load frame between first and second positions wherein the first and second pairs of lug support assemblies are selectively aligned with different ones of their respective sets of plates, said lug support members being sized to engage the lift lugs of the respective set of plates in the respective lug supporting positions with the load frame in its first position and the grab means in one of its first and second positions associated with the respective plates of each set of plates; and means for moving said load frame from its first position in direction away from said container.

13. The apparatus of claim 12 wherein said means for aligning said load frame with said holding container comprises an aligner frame having a vertical portion for slidably mounting said load frame for vertical movement toward and away from said container, said aligner frame having mechanical interfitting alignment means engaging a portion of said container for positively positioning said load frame relative to the container.

14. The apparatus of claim 13 wherein said aligner frame includes a pair of slotted comb members, one positioned adjacent each side of the aligner frame and extending in a longitudinal direction of the load frame, said comb members each having a plurality of slots, said grab means moving with said load frame in vertical direction to lift plates engaged by the respective lug support members from the container as the load frame is moved along said vertical portions of said aligner frame, said slots in said comb members being spaced to receive edge portions of each of the plates being lifted by the respective lug support members after the grab means have been raised relative to the aligner frame, said comb members being pivotable from a first position wherein they clear plates held by said grab means and raised with said load frame relative to said aligner frame, to a second position wherein the plates are each received in a slot of each of the comb members at the opposite edges of the plates.

15. The device of claim 14 and a pair of safety bar members mounted on said load frame adjacent the side edges thereof, said safety bar members each being of length to extend along the longitudinal length of the load frame, and means for pivotally mounting said safety bar members on said load frame so that said safety bar members are movable from a first position wherein the safety bar members are adjacent the side edges of plates held by said grab means and lifted relative to the aligner frame with said load frame, to a second position wherein said safety bar members are laterally clear of plates held by said grab means, said plates each having header means extending laterally along the plates outwardly beyond the side edges, said safety bar members being positioned below said header means on opposite sides of said plates when said safety bar members are in their first positions.

* * * * *

UNITED STATES PATENT OFFICE

CERTIFICATE OF CORRECTION

Patent No. 4,326,937 Dated April 27, 1982

Inventor(s) Karl E. Neumeier et al.

It is certified that error appears in the above-identified patent and that said Letters Patent are hereby corrected as shown below:

Column 6, line 38, (Claim 3, line 3) after "said" remove --fixed positioning member on said--.

Signed and Sealed this

Sixth Day of July 1982

[SEAL]

Attest:

GERALD J. MOSSINGHOFF

Attesting Officer

Commissioner of Patents and Trademarks